US010576737B2

(12) United States Patent
Serizawa et al.

(10) Patent No.: US 10,576,737 B2
(45) Date of Patent: Mar. 3, 2020

(54) RECORDING APPARATUS AND RECORDING METHOD

(71) Applicant: CANON KABUSHIKI KAISHA, Tokyo (JP)

(72) Inventors: Kouichi Serizawa, Yokohama (JP); Satoshi Kitai, Kawasaki (JP); Masahiko Umezawa, Kawasaki (JP); Atsushi Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 15/938,515

(22) Filed: Mar. 28, 2018

(65) Prior Publication Data

US 2018/0281399 A1 Oct. 4, 2018

(30) Foreign Application Priority Data

Apr. 4, 2017 (JP) ..... 2017-074679

(51) Int. Cl.
*B41J 2/45* (2006.01)
*B41J 2/05* (2006.01)
(Continued)

(52) U.S. Cl.
CPC ..... *B41J 2/04528* (2013.01); *B41J 2/0452* (2013.01); *B41J 2/0458* (2013.01);
(Continued)

(58) Field of Classification Search
CPC ..... B41J 2/04586; B41J 2/04528; B41J 2/04531; B41J 2/0458; B41J 2/04563; B41J 2/05; B41J 2002/012; B41J 2202/16
See application file for complete search history.

(56) References Cited

U.S. PATENT DOCUMENTS 4,791,435 A * 12/1988 Smith ..... B41J 2/04515 346/139 R
4,980,702 A * 12/1990 Kneezel ..... B41J 2/04541 338/308
(Continued)

FOREIGN PATENT DOCUMENTS

CN 1942323 A 4/2007
CN 103717402 A 4/2014
(Continued)

*Primary Examiner* — Shelby L Fidler
(74) *Attorney, Agent, or Firm* — Canon U.S.A., Inc. IP Division

(57) ABSTRACT

A recording apparatus includes a recording head having a plurality of recording elements configured to generate energy for discharging ink, a first heating element configured to heat ink in the vicinity of one of said recording elements positioned at a first position, insufficiently to discharge ink, and a second heating element positioned at a second position different from the first position, which are arranged on a same substrate, a heating control unit configured to control the heating operation of the ink by driving the first and the second heating elements by applying voltage to the first and the second heating elements, and a recording control unit configured to control the recording operation by driving the plurality of recording elements, wherein the heating control unit is configured to control the heating operation to drive the first heating element and the second heating element at timings different from each other.

16 Claims, 14 Drawing Sheets

| TEMPERATURE | 124a | 124j | 124i | 124h | 124g | 124f | 124e | 124d | 124c | 124b |
|---|---|---|---|---|---|---|---|---|---|---|
| T < 50°C | 1 | 1 | 1 | 1 | 1 | 0 | 0 | 0 | 0 | 0 |
| T ≥ 50°C | 0 | 0 | 0 | 0 | 0 | 0 | 0 | 0 | 0 | 0 |

READING START POSITION

(51) Int. Cl.
*B41J 2/01* (2006.01)
*B41J 2/045* (2006.01)

(52) U.S. Cl.
CPC ..... *B41J 2/04531* (2013.01); *B41J 2/04563* (2013.01); *B41J 2/04573* (2013.01); *B41J 2/05* (2013.01); *B41J 2002/012* (2013.01); *B41J 2202/16* (2013.01)

(56) References Cited

U.S. PATENT DOCUMENTS 5,223,853 A * 6/1993 Wysocki ..... B41J 2/04541 347/14
5,497,174 A * 3/1996 Stephany ..... B41J 2/04568 347/13
5,623,297 A * 4/1997 Austin ..... B41J 2/365 347/194
6,276,776 B1 * 8/2001 Umezawa ..... B41J 2/04528 347/17
2005/0168561 A1 8/2005 Furuki et al.
2007/0242093 A1 * 10/2007 Fujimoto ..... B41J 2/04543 347/9
2009/0160898 A1 * 6/2009 Bergstedt ..... B41J 2/04528 347/17
2010/0165053 A1 7/2010 Bergstedt et al.
2014/0063128 A1 * 3/2014 Kasai ..... B41J 2/04528 347/56
2014/0098155 A1 * 4/2014 Martin ..... B41J 2/32 347/17
2014/0300660 A1 10/2014 Hirayama et al.
2018/0311956 A1 * 11/2018 Clark ..... B41J 2/2146

FOREIGN PATENT DOCUMENTS

JP 03-005151 A 1/1991
WO 2013/019181 A1 2/2013
WO WO-2013019181 A1 * 2/2013 ..... B41J 2/32

* cited by examiner

FIG.6

| TEMPERATURE | 124a | 124j | 124i | 124h | 124g | 124f | 124e | 124d | 124c | 124b |
|---|---|---|---|---|---|---|---|---|---|---|
| T < 50°C | 1 | 1 | 1 | 1 | 1 | 0 | 0 | 0 | 0 | 0 |
| T ≥ 50°C | 0 | 0 | 0 | 0 | 0 | 0 | 0 | 0 | 0 | 0 |

READING START POSITION

FIG.9

| DIFFERENCE BETWEEN DETECTED TEMPERATURE AND TARGET TEMPERATURE [°C] | SUB-HEATER DRIVING INTENSITY [%] |
|---|---|
| 30 ≤ T | 90 |
| 25 ≤ T < 30 | 80 |
| 20 ≤ T < 25 | 70 |
| 15 ≤ T < 20 | 60 |
| 10 ≤ T < 15 | 50 |
| 7 ≤ T < 10 | 40 |
| 5 ≤ T < 7 | 30 |
| 3 ≤ T < 5 | 20 |
| 0 < T < 3 | 10 |
| 0 ≤ T | 0 |

FIG.10

| SUB-HEATER INTENSITY | 124a | 124j | 124i | 124h | 124g | 124f | 124e | 124d | 124c | 124b |
|---|---|---|---|---|---|---|---|---|---|---|
| 90% | 1 | 1 | 1 | 1 | 1 | 1 | 1 | 1 | 1 | 0 |
| 80% | 1 | 1 | 1 | 1 | 1 | 1 | 1 | 1 | 0 | 0 |
| 70% | 1 | 1 | 1 | 1 | 1 | 1 | 1 | 0 | 0 | 0 |
| 60% | 1 | 1 | 1 | 1 | 1 | 1 | 0 | 0 | 0 | 0 |
| 50% | 1 | 1 | 1 | 1 | 1 | 0 | 0 | 0 | 0 | 0 |
| 40% | 1 | 1 | 1 | 1 | 0 | 0 | 0 | 0 | 0 | 0 |
| 30% | 1 | 1 | 1 | 0 | 0 | 0 | 0 | 0 | 0 | 0 |
| 20% | 1 | 1 | 0 | 0 | 0 | 0 | 0 | 0 | 0 | 0 |
| 10% | 1 | 0 | 0 | 0 | 0 | 0 | 0 | 0 | 0 | 0 |
| 0% | 0 | 0 | 0 | 0 | 0 | 0 | 0 | 0 | 0 | 0 |

READING START POSITION

FIG.12

| TEMPERATURE DIFFERENCE T | 124a | 124j | 124i | 124h | 124g | 124f | 124e | 124d | 124c | 124b |
|---|---|---|---|---|---|---|---|---|---|---|
| 30 ≤ T | 1 | 1 | 1 | 1 | 1 | 1 | 1 | 1 | 1 | 0 |
| 25 ≤ T < 30 | 1 | 1 | 1 | 1 | 1 | 1 | 1 | 1 | 0 | 0 |
| 20 ≤ T < 25 | 1 | 1 | 1 | 1 | 1 | 1 | 1 | 0 | 0 | 0 |
| 15 ≤ T < 20 | 1 | 1 | 1 | 1 | 1 | 1 | 0 | 0 | 0 | 0 |
| 10 ≤ T < 15 | 1 | 1 | 1 | 1 | 1 | 0 | 0 | 0 | 0 | 0 |
| 7 ≤ T < 10 | 1 | 1 | 1 | 1 | 0 | 0 | 0 | 0 | 0 | 0 |
| 5 ≤ T < 7 | 1 | 1 | 1 | 0 | 0 | 0 | 0 | 0 | 0 | 0 |
| 3 ≤ T < 5 | 1 | 1 | 0 | 0 | 0 | 0 | 0 | 0 | 0 | 0 |
| 0 < T < 3 | 1 | 0 | 0 | 0 | 0 | 0 | 0 | 0 | 0 | 0 |
| T < 0 | 0 | 0 | 0 | 0 | 0 | 0 | 0 | 0 | 0 | 0 |

READING START POSITION

FIG.13

| TEMPERATURE | 124a 124f | 124e 124j | 124d 124i | 124c 124h | 124b 124g |
|---|---|---|---|---|---|
| T < 50°C | 1 | 1 | 1 | 1 | 0 |
| T ≥ 50°C | 0 | 0 | 0 | 0 | 0 |

READING START POSITION

RECORDING APPARATUS AND RECORDING METHOD

BACKGROUND OF THE INVENTION

Field of the Invention

The present invention relates to a recording apparatus and a recording method.

Description of the Related Art

There is provided a recording apparatus which records an image by using a recording head including a substrate on which a plurality of recording elements for generating heat energy for discharging ink is arranged. In the above-described recording apparatus, if the temperature the vicinity of a recording element is lowered, the amount of discharged ink may be reduced considerably, which may then lower the ink density of the recorded image.

In order to suppress the considerable reduction in the discharged amount caused due to the lowering of temperatures, Japanese Patent Application Laid-Open No. 3-005151 discusses a recording head including a substrate an which heating elements different from the recording elements are further arranged. According to Japanese Patent Application Laid-Open No. 3-005151, when the temperature is lowered, the above-described lowering of density can be suppressed by heating in the vicinity of the recording element by driving the heating element.

However, if a set of heating elements described in Japanese Patent Application Laid-Open No. 3-005151 is used, there is a risk that the above-described temperature control cannot be performed in a favorable manner because of the temperature distribution of the ink on the substrate.

For example, it is assumed that a temperature is comparatively low at a position A on the substrate and has not reached a target temperature of heating performed by the heating element, whereas a temperature is comparatively high at a position B and has reached the target temperature thereof. Although an amount of discharge caused by a recording element positioned at the position A is considerably low, an amount of discharge caused by a recording element positioned at another position is ideal. At this time, if heating is not performed by the heating elements, image quality will be lowered because the amount of discharge caused by the recording element positioned at the position A is extremely low. On the other hand, if heating is performed by the heating elements, the temperature is further increased at the position B, and the amount of discharge caused by the recording element positioned at the position B is increased excessively, so that density of the image will be high.

The above-described problem can be solved if a plurality of heating elements is arranged at different positions on the substrate, and heating is individually executed by the heating elements at respective positions. For example, in the above-described example, heating elements for heating the positions A and B are arranged separately, and the heating element corresponding to the position B does not perform heating, while the heating element corresponding to the position A performs heating. With this configuration, deviation from an ideal discharge amount can be suppressed at both of the positions, so that an image with small density variations (i.e., an image with substantially ideal density) can be recorded.

However, as a result of examinations conducted by inventors, it has been found that the following problem occurs if heating is individually performed by a plurality of heating elements. If a large number of heating elements are switched from a non-driving state to a driving state at the same timing, inrush current occurring when the non-driving state is switched to the driving state is superimposed, so that there is a risk in which a load with respect to an electric circuit is increased, or induction noise is generated to cause an error in data transmission between the recording head and the recording apparatus.

The present invention is directed to a method suppressing a negative effect caused by superimposition of inrush current in a case where a recording head having a plurality of heating elements arranged on a same substrate is to be used.

SUMMARY OF THE INVENTION

According to an aspect of the present invention, a recording apparatus includes a recording head having a plurality of recording elements configured to generate energy for discharging ink, a first heating element configured to heating ink in the vicinity of one of said recording elements positioned at a first position, insufficiently to discharge ink, and a second heating element configured to heat ink in the vicinity of a recording element positioned at a second position different from the first position, insufficiently to discharge ink, wherein the first and second positions are arranged on a same substrate, a heating control unit configured to control the heating operation of the ink by driving the first and the second heating elements by applying voltage to the first and the second heating elements, and a recording control unit configured to control the recording operation by driving the plurality of recording elements, wherein the heating control-unit is configured to control the heating operation to drive the first heating element and the second heating element at timings different from each other.

Further features of the present invention will become apparent from the following description of exemplary embodiments with reference to the attached drawings.

BRIEF DESCRIPTION OF THE DRAWINGS

FIG. 6 is a diagram illustrating a sub-heater driving table of the exemplary embodiment.

FIG. 9 is a diagram illustrating a sub-heater driving table of the exemplary embodiment.

FIG. 10 is a diagram illustrating a sub-heater driving table of the exemplary embodiment.

FIG. 12 is a diagram illustrating a sub-heater driving table of the exemplary embodiment.

FIG. 13 is a diagram illustrating a sub-heater driving table of the exemplary embodiment.

DESCRIPTION OF THE EMBODIMENTS

Figure 1:
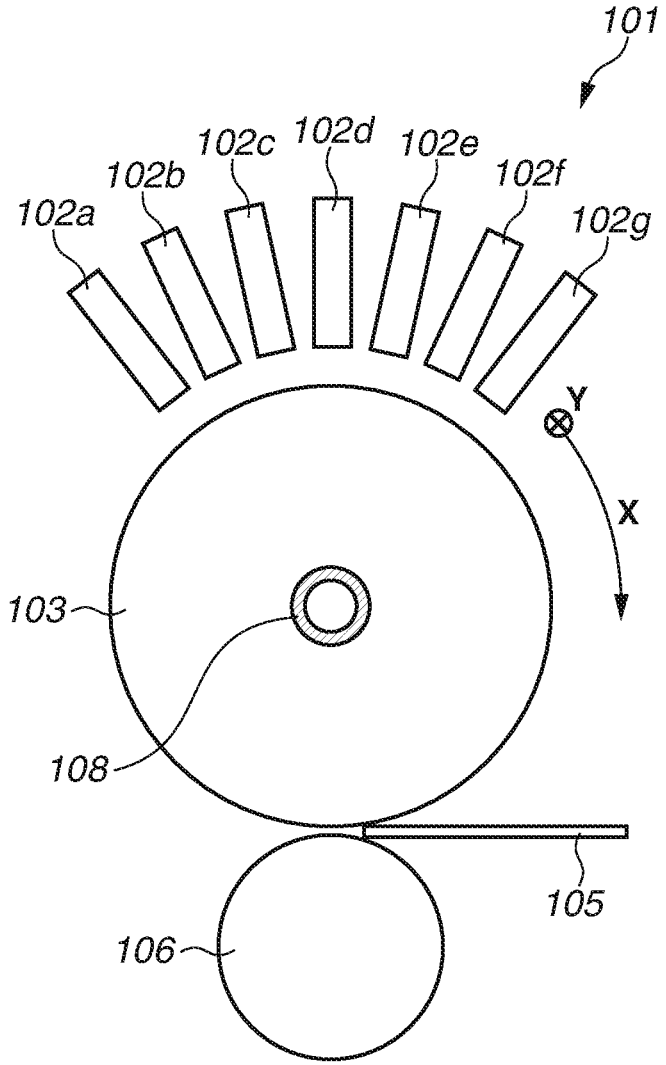
FIG. 1 is a diagram illustrating an internal configuration of a recording apparatus of an exemplary embodiment.
Figure 2:
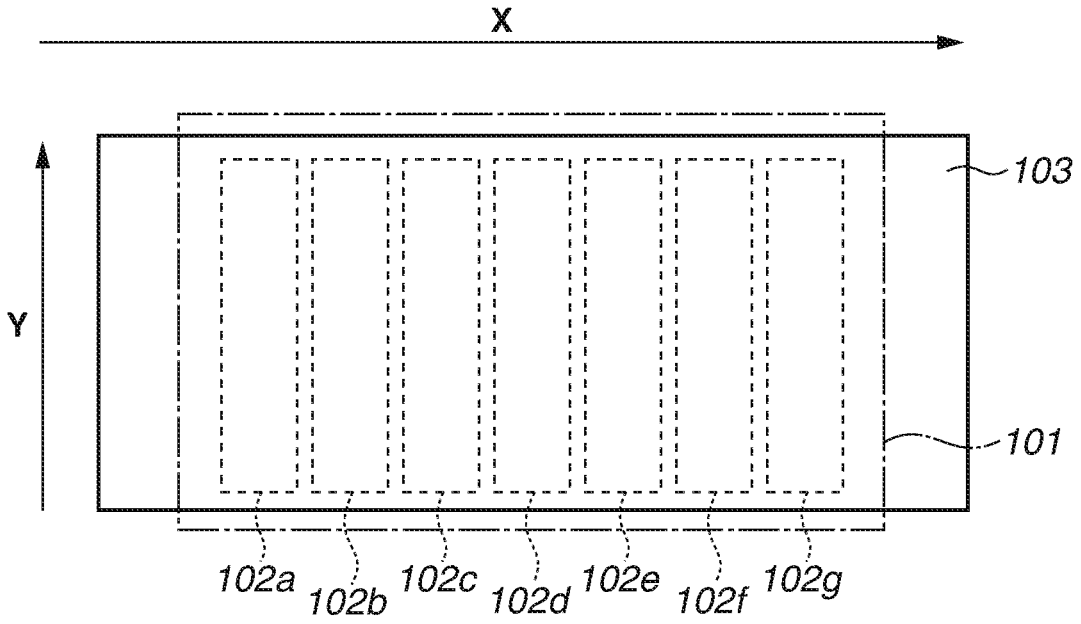
FIG. 2 is a diagram illustrating an internal configuration of the recording apparatus of the exemplary embodiment.

FIG. 1 is a diagram illustrating a configuration of an ink jet recording apparatus of a first exemplary embodiment (hereinafter, also referred to as "recording apparatus") in a vicinity of a recording unit viewed in an axis direction (Y-direction) of a transfer body. Further, FIG. 2 is a diagram illustrating the configuration of the recording unit 101 when the area containing the recording unit 101 is viewed from an internal portion of the transfer body 103.

The recording unit 101 for discharging ink is arranged on the recording apparatus. The recording unit 101 includes seven recording heads 102*a* to 102*g* for discharging ink of different colors, which are arranged in an X-direction (i.e., rotation direction or scanning direction). Specifically, the recording head 102*a* discharges cyan ink (C), the recording head 102*b* discharges magenta ink (M), the recording head 102*c* discharges yellow ink (Y), the recording head 102*d* discharges black ink (K), the recording head 102*e* discharges light-cyan ink (Lc), the recording head 102*f* discharges light-magenta ink (Lm), and the recording head 102*g* discharges gray ink (Gy). Although details will be described below, a plurality of recording element arrays including a plurality of recording elements that generates heat energy for discharging ink of each color arrayed in the Y-direction (i.e., array direction) is arranged on each of the recording heads 102*a* to 102*g*.

The transfer body 103 (first recording medium) is arranged on a discharge face side (lower side) of the recording unit 101 included in the recording apparatus. Ink of respective colors are discharged to the transfer body 103 from the recording heads 102*a* to 102*g* while the transfer body 103 is being rotated in the X-direction (rotation direction) through a rotation mechanism (not illustrated), so that an image is recorded on the transfer body 103.

A conveyance roller 106 is arranged to be in contact with the transfer body 103 and rotated in a direction (−X direction) opposite to the rotation direction of the transfer body 103 by a conveyance mechanism (not illustrated). At a contact portion between the transfer body 103 and the conveyance roller 106, an image formed on a surface of the transfer body 103 is transferred to a recording sheet (second recording medium) 105 conveyed by the conveyance mechanism (not illustrated), so that the image is recorded on the recording sheet 105.

A linear encoder 108 on which a slit is provided at predetermined intervals is attached to a shaft of the transfer body 103. Further, a linear encoder sensor (not illustrated) is arranged at a position at which the linear encoder 108 is detectable. The linear encoder 108 rotates along with rotation of the transfer body 103, and the linear encoder sensor detects respective slits provided on the linear encoder 108, so that a discharge timing of ink discharged from each of the recording heads 102*a* to 102*g* is adjusted based on the detection timing. Herein, although a configuration in which the linear encoder 108 is attached to the shaft of the transfer body 103 is described, the linear encoder 108 may be attached to a position away from the shaft of the transfer body 103. Further, a rotary encoder may be arranged on the shaft of the transfer body 103.

<Recording Head>

Figure 3A:
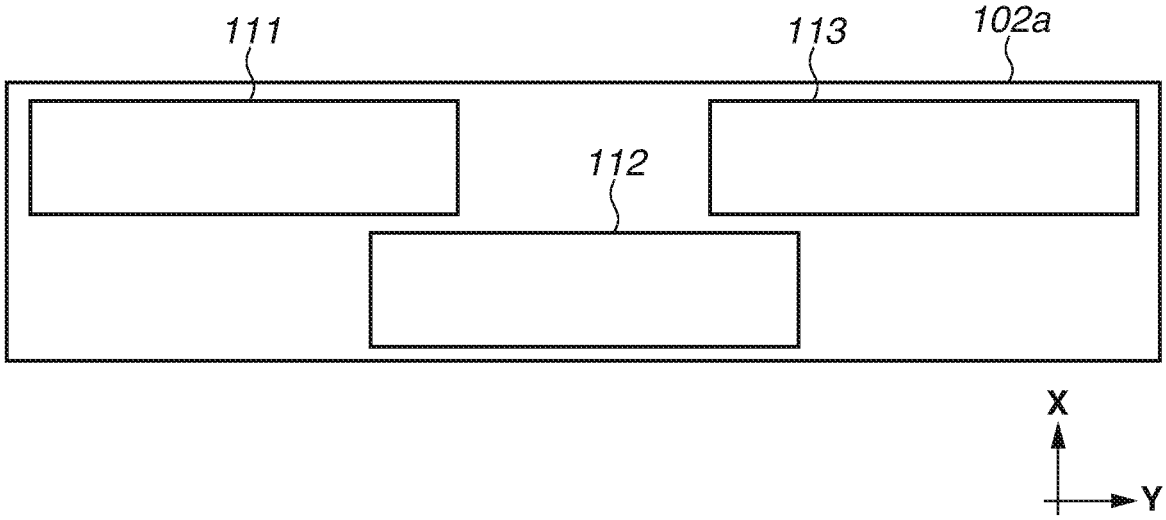
FIGS. 3A and 3B are diagrams illustrating a recording head of the exemplary embodiment.
Figure 3B:
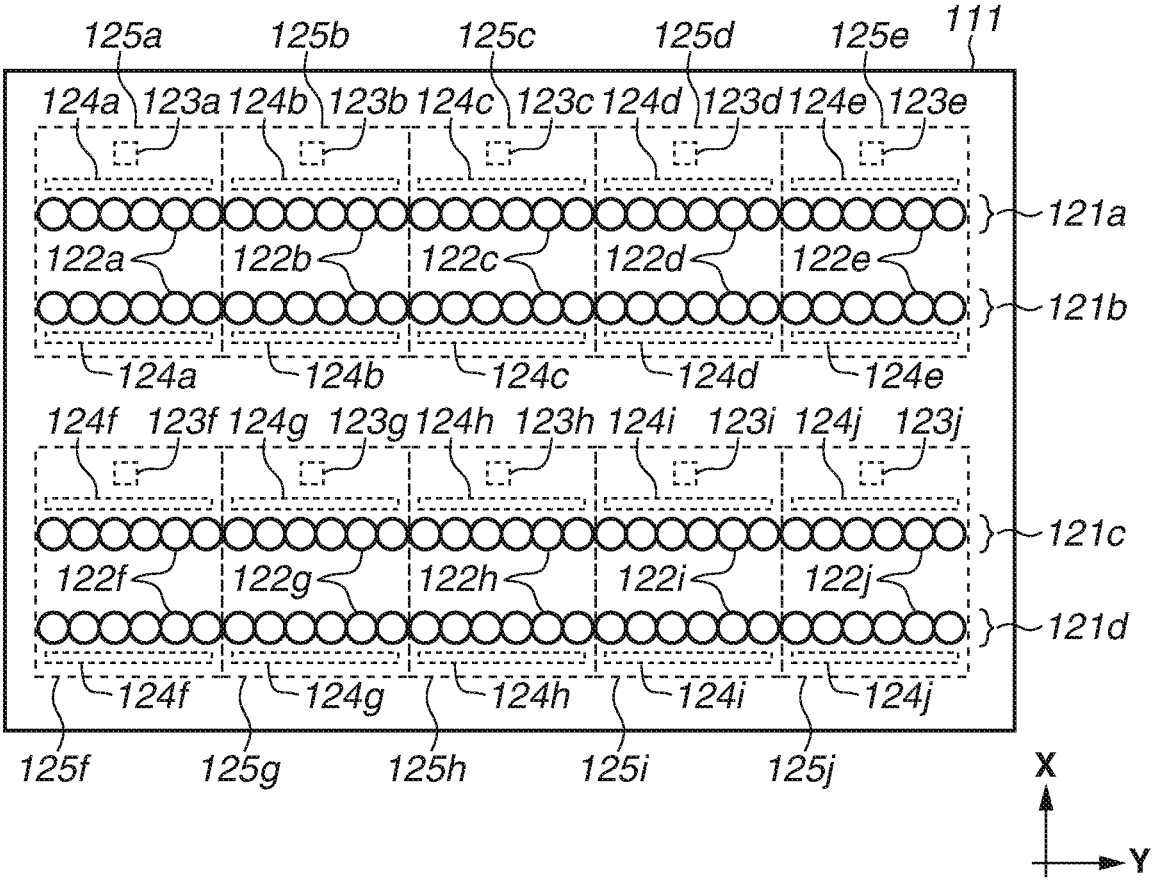

FIGS. 3A and 3B are diagrams illustrating a configuration of the recording head 102*a* for cyan ink used in the present exemplary embodiment. In the following description, for the sake of simplicity, although only the recording head 102*a* will be described from among the recording heads 102*a* to 102*g*, configurations of the recording heads 102*b* to 102*g* other than the recording head 102*a* are similar to that of the recording head 102*a*.

FIG. 3A is a diagram schematically illustrating a heater board arranged on the recording head 102*a*. Further, FIG. 3B is a diagram schematically illustrating respective members arranged on a heater board 111.

As illustrated in FIG. 3A, in the present exemplary embodiment, three heater boards (substrate) 111, 112, and 113 are arranged on the recording head 102*a*. A heating element and a recording element are arranged on each of the heater boards 111, 112, and 113. The heating element and the recording element are formed as films on a silicon substrate. The heater boards 111, 112, and 113 are arranged in the Y direction with end portions thereof in the Y direction partially overlapping with each other.

Then, four discharge port arrays for discharging ink are arranged on each of the heater boards 111, 112, and 113. These four discharge port arrays are arranged in the X-direction (intersecting direction). For example, as illustrated in FIG. 3B, four discharge port arrays 121*a*, 121*b*, 121*c*, and 121*d* are arranged on the heater board 111. Herein, discharge ports for discharging ink are arranged in the Y-direction (predetermined direction) to form each of the discharge port arrays 121*a*, 121*b*, 121*c*, and 121*d*.

Then, a recording element as an electrothermal conversion element is arranged at a position (an inner position in the vicinity of a discharge port) corresponding to each of the discharge ports. Accordingly, an array of recording elements (recording element array) is formed at a position corresponding to each of the discharge port arrays. When ink is to be discharged, a driving pulse (voltage) is applied to the recording elements via an electric wiring connected thereto. The recording elements are driven by the driving pulse to generate heat energy, so that discharge operation is executed through respective discharge ports by using the generated thermal energy.

Temperature sensors (detection elements) 123*a* to 123*j* and heating elements (sub-heaters) 124*a* to 124*j* are arranged on the heater board 111 in addition to the discharge port arrays 121*a* to 121*d* and the recording elements. Each of the temperature sensors 123*a* to 123*j* is a member for detecting a temperature in a vicinity area, and each of the sub-heaters 124*a* to 124*j* is a member for heating a vicinity area and retaining the temperature.

Herein, the heater board 111 is divided into ten heating areas 125*a* to 125*j* according to positions on the heater board 111. The heating areas 125*a* to 125*e* respectively include discharge port portions 122*a* to 122*e* consisting of portions of the discharge port arrays 121*a* and 121*b* divided in the Y-direction. Further, the heating areas 125*f* to 125*j* respectively include discharge port portions 122*f* to 122*j* consisting of portions of the discharge port arrays 121*c* and 121*b* divided in the Y-direction.

Then, the temperature sensor and the sub-heater are arranged in each heating area of the heater board of the present exemplary embodiment. For example, the temperature sensor 123*a* for detecting a temperature of ink in a vicinity of the discharge port portion 122*a* and the sub-heater 124*a* for heating ink in a vicinity of the discharge port portion 122*a* are arranged in the heating area 125*a* on the heater board 111. In FIG. 3E, although the sub-heater 124*a* is divided into two portions, the two portions are connected with the same wiring, and driving or non-driving of the two portions is performed integrally and consistently. Therefore, the two portions are substantially treated as one sub-heater 124*a*. Although the heating area 125*a* is described, the same can be said for the other heating areas 125*b* to 125*j*. Further, the same can be also said for the heater boards 112 and 113. Accordingly, 30 (10×3=30) pieces each of temperature sensors and sub-heaters are arranged on each of the recording heads 102*a* to 102*g* used in the present exemplary embodiment.

As illustrated in FIG. 3B, the temperature sensor and the sub-heater are arranged at each heating area on the heater board, and temperature detection and temperature retention control are executed at each heating area, so that the temperature distribution on the heater board (substrate) can be reduced (i.e., temperature can be uniform). For example, if the temperature of the heating areas 125*a* to 125*c* is low whereas the temperature of the heating areas 125*d* to 125*j* is approximately the same as the target temperature, only the heating areas 125*a* to 125*c* can be heated by driving the sub-heaters 124*a* to 124*c*. With this configuration, lowering of the temperature in the heating areas 125*a* to 125*c* can be suppressed, and a temperature difference within the heater board 111 can be reduced.

<Recording Control System>

Figure 4:
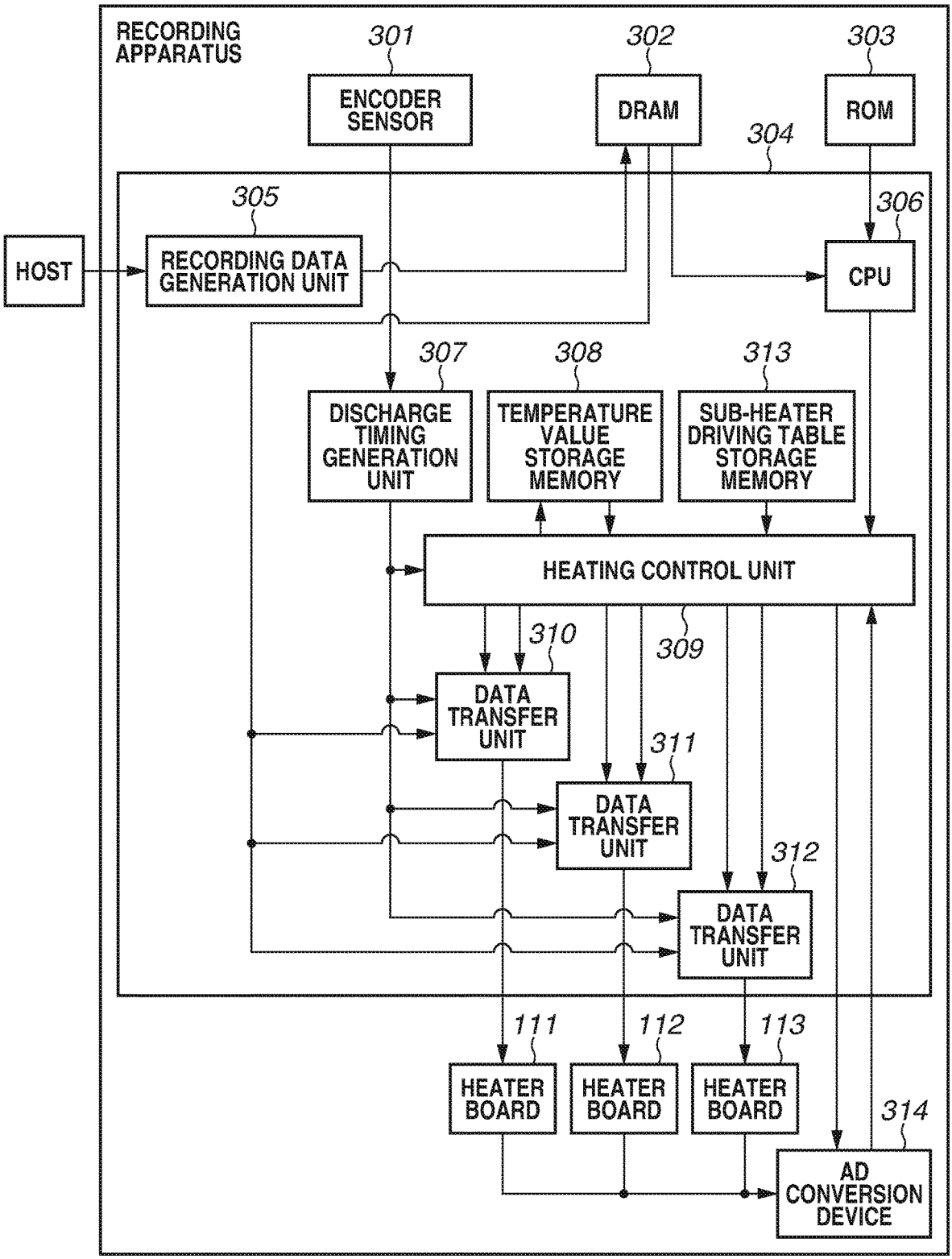
FIG. 4 is a block diagram illustrating a recording control system of the exemplary embodiment.

FIG. 4 is a diagram illustrating a configuration of a recording control system in the recording apparatus of the present exemplary embodiment. Herein, for the sake of simplicity, only a recording control system relating to the recording head 102*a* will be described although the recording apparatus of the present exemplary embodiment includes seven recording heads 102*a* to 102*g* as illustrated in FIGS. 1 and 2.

As illustrated in FIG. 4, the recording apparatus includes an encoder sensor 301, a dynamic random access memory (DRAM) 302, a read only memory (ROM) 303, and a controller (application specific integrated circuit (ASIC)) 304. The recording apparatus further includes the above-described heater boards 111 to 113 and an analog-digital (AD) conversion device 314.

Then, a recording data generation unit 305, a central processing unit (CPU) 306, a discharge timing generation unit 307, a temperature value storage memory 308, a sub-heater driving table storage memory (table storage memory) 313, and data transfer units 310 to 312 are arranged on the controller 304.

The CPU 306 reads and executes a program stored in the ROM 303 to control operation of the entire recording apparatus such as driving operation of a driver such as a motor. Further, fixed data necessary for various kinds of operation of the recording apparatus is stored in the ROM 303 in addition to various control programs executed by the CPU 306. For example, a program for executing recording control of the recording apparatus is stored.

The DRAM 302 is necessary for the CPU 306 to execute a program. The DRAM 302 is used as a work area of the CPU 306 or a temporary storage area of various received data, and various setting data may be stored. Further, although only one DRAM 302 is illustrated in FIG. 4, a plurality of DRAMs may be mounted, or both of a DRAM and a static random access memory (SRAM) may be mounted as a plurality of memories having different access speeds.

The recording data generation unit 305 receives image data from a host (personal computer (PC)) outside the recording apparatus. Then, the recording data generation unit 305 executes color conversion processing or quantization processing on the image data, generates recording data used for discharging ink from the recording head 102*a*, and stores the generated recording data in the DRAM 302.

The discharge timing generation unit 307 receives position information indicating relative positions of the recording head 102*a* and the recording medium 103 detected by the encoder sensor 301. Then, based on the position information, the discharge timing generation unit 307 generates discharge timing information indicating a timing of discharging ink from the recording head 102*a*.

Three data transfer units 310, 311, and 312 read recording data stored in the DRAM 302 according to the discharge timing generated by the discharge timing generation unit 307. Further, sub-heater driving information generated as described below is also read from a heating control unit 309. Then, each of the data transfer units 310, 311, and 312 transfers the recording data and the sub-heater driving information to each of the heater board 111, 112, and 113 via a wiring substrate.

Each of the heater boards 111, 112, and 113 uses the transferred recording data to drive the recording elements to discharge ink, and outputs the output values of temperature sensors within the heater board to the AD conversion device 314. Further, in order to reduce the number of signals simultaneously input to the AD conversion device 314, output values of temperature sensors are sequentially input to the AD conversion device 314 one by one from all of the temperature sensors arranged on the heater boards 111, 112, and 113. The AD conversion device 314 converts the output values of the temperature sensors into digital values (temperature values), and outputs those temperature values to the heating control unit 309.

At this time, in the present exemplary embodiment, it will take 50 μs to detect a temperature from one temperature senor. As described above, the three heater boards 111, 112, and 113 are arranged on the recording head 102*a*, and ten temperature sensors are arranged on each of the heater boards 111, 112, and 113. Therefore, it will take 1500 μs (50×3×10) for the heating control unit 309 to update temperature values of all of the temperature sensors. In consideration of the above situation, in the present exemplary embodiment, the temperature value of one temperature sensor is updated every 1500 μs.

The heating control unit 309 stores the temperature values received from the AD conversion device 314 in the temperature value storage memory 308. Then, the heating control unit 309 reads out the latest temperature value stored in the temperature value storage memory 308 according to an input of the discharge timing information, and generates the sub-heater generation information at each heater board based on the heating control table of the heater board previously stored in the sub-heater driving table storage memory 313. As described above, the generated sub-heater driving information is output to the data transfer units 310, 311, and 312.

<Sub-Heater Heating Control>

Figure 5:
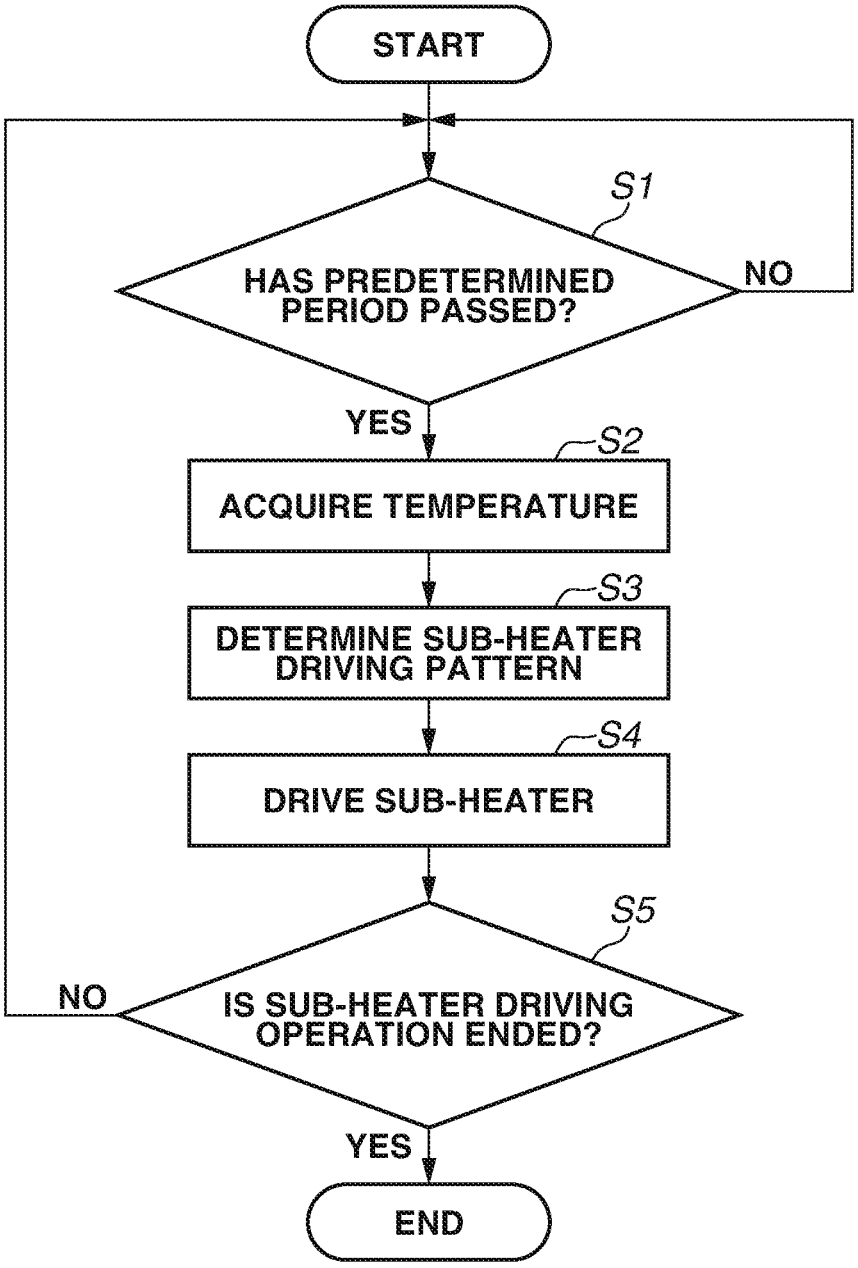
FIG. 5 is a flowchart illustrating heating control of the exemplary embodiment.

FIG. 5 is a flowchart of sub-heater heating control executed by the heating control unit 309 and the recording head 102*a* of the present exemplary embodiment. Through the sub-heater heating control, sub-heaters arranged in respective heating areas of the recording heads 102*a* to 102*g* are driven to retain the temperature of ink during a recording period, when the recording elements are being driven to cause ink to be discharged from the recording heads 102*a* to 102*g*. Herein, of the recording heads 102*a* to 102*h*, only control with respect to the recording head 102*a* will be described. However, similar control is also executed with respect to the other recording heads 102*b* to 102*h*. In the present exemplary embodiment, a target temperature is set to 50° C.

When recording is started, sub-heater heating operation is also started. In step S1, the heating control unit 309 determines whether a predetermined period has passed after previous sub-heater heating operation is executed. The processing in step S1 may be omitted if recording operation and sub-heater heating operation have just been started. Herein, although a different time period can be appropriately set as the predetermined period, a period the same as the update interval of the temperature value, i.e., 1500 μs, is set thereto.

In step S2, the heating control unit 309 reads out the latest stored temperature value from the temperature value storage memory 308. Because reading is executed at each of the temperature sensors, temperature values of ten pieces each of temperature sensors respectively arranged on three heater boards, i.e., temperature values of thirty temperature sensors in total, will be acquired.

In step S3, based on the sub-heater driving table stored in the sub-heater driving table storage memory 313 and the temperature values acquired in step S2, a sub-heater driving pattern for driving the sub-heater is determined as the sub-heater driving information. The sub-heater driving table of the present exemplary embodiment directly specifies a correspondence between a temperature and a sub-heater driving pattern indicating a driving timing of the sub-heater. In step S3, the heating control unit 309 refers to the sub-heater driving table and determines the sub-heater driving pattern corresponding to the temperature detected by each of the temperature sensors. A determination method of the sub-heater driving pattern will be described below.

In step S4, the heating control unit 309 drives the sub-heater according to the determined sub-heater driving pattern and retains a temperature of ink in the vicinity of a recording element group belonging to the corresponding heating area.

Thereafter, the processing proceeds to step S5. In step S5, the heating control unit 309 determines whether the sub-heater heating operation has been ended. In the present exemplary embodiment, sub-heater heating operation is ended when recording is ended. If it is determined that sub-heater heating operation has not been ended (i.e., recording has not been ended) (NO in step S5), the processing returns to step S1, and the heating control unit 309 drives the sub-heater according to the sub-heater driving pattern determined in previous step S3 until the predetermined period has passed. Then, when the predetermined period has passed, the processing proceeds to step S2 again, so that the temperature value is updated and similar control processing is continued. If the heating control unit 309 determines that sub-heater heating operation has been ended (YES in step S5), the processing flow illustrated in FIG. 5 is ended.

FIG. 6 is a diagram illustrating a sub-heater driving table used for the present exemplary embodiment. In the sub-heater driving table, "1" represents output of a driving signal indicating driving of the sub-heater, whereas "0" represents output of a driving signal indicating non-driving of the sub-heater.

Of the two rows one above the other in FIG. 6, the upper row illustrates a sub-heater driving pattern to be selected when the temperature is less than 50° C., and the lower row illustrates a sub-heater driving pattern to be selected when temperature is 50° C. or more. Further, driving signals are output according to passage of time while a reading position is being shifted from left to right every 10 μs. The reading position returns to the left end after being shifted to the right end, so that the driving signals are output while the reading position is being shifted from left to right sequentially.

For example, if reading of the sub-heater driving pattern is started from the left end, the driving signals are output in the order of 1, 1, 1, 1, 1, 0, 0, 0, 0, and 0 if the temperature is less than 50° C. Accordingly, the sub-heater is driven for the first 50 μs (corresponding to the first five driving signals represented by "1") and is not driven for the subsequent 50 μs (corresponding to the first five driving signals represented by "0"). Thereafter, the reading position returns to the left end of the sub-heater driving pattern, so that the sub-heater is driven for the next 50 μs, and is not driven for the following 50 μs. As described above, because the sub-heater is driven to a certain extent if the temperature is less than 50° C., the temperature of vicinity ink can be prevented from being lowered.

Further, if the temperature is 50° C. or more, "0" which represents the driving signal indicating non-driving of the sub-heater is specified at every position. This is because the temperature is higher than the target temperature, and thus driving of the sub-heater is not executed in order to prevent excessive rise in the temperature.

Herein, if the left end of the sub-heater driving pattern in FIG. 6 is specified as a reading start position of the driving signal of all of the ten sub-heaters 124*a* to 124*j* arranged on the heater board 111, excessive amount of inrush current will flow into the heater board 111, possibly increasing a load with respect to an electric circuit of the heater board 111 or possibly causing data transmission error due to induction noise.

For example, if a temperature lower than 50° C. is detected at all of the ten temperature sensors 123*a* to 123*j*, the driving signals are output in the order of 1, 1, 1, 1, 1, 0, 0, 0, 0, and 0 with respect to all of the sub-heaters 124*a* to 124*j*. Therefore, all of the sub-heaters 124*a* to 124*j* in a non-driving state are switched to a driving state at the same timing immediately after the sub-heater heating control is started. If electric current is to be applied to a circuit to which the electric current has not been applied, electric current (inrush current) higher than the electric current applied in its steady state may flow into the circuit. If a reading start position of the sub-heater driving table is the same at each of the sub-heaters 124*a* to 124*j*, the above-described high current is superimposed at all of the sub-heaters 124*a* to 124*j* at the same timing, so that the above-described increase in the load of the electric circuit or the data transmission error will occur.

In consideration of the above problem, in the present exemplary embodiment, although the same sub-heater driving pattern illustrated in FIG. 6 is applied to the ten sub-heaters 124*a* to 124*j* arranged on the heater board 111, a reading start position of the sub-heater driving pattern is set differently at each of the sub-heaters 124*a* to 124*j*. For example, the driving signals are read from the left end of the sub-heater driving table in FIG. 6 with respect to the sub-heater 124*a*, whereas the driving signals are read from the right end with respect to the sub-heater 124*b*. As illustrated in FIG. 6, different reading start positions of the sub-heater driving table are set for other sub-heaters 124*c* to 124*j*.

If the temperature detected at all of the temperature sensors 123*a* to 123*j* is lower than 50° C., the sub-heater driving table is read from the left end with respect to the sub-heater 124*a*, so that driving signals are output in the order of 1, 1, 1, 1, 1, 0, 0, 0, 0, and 0. On the other hand, because the sub-heater driving table is read from the right end with respect to the sub-heater 124*b*, the driving signals are output in the order of 0, 1, 1, 1, 1, 1, 0, 0, 0, and 0. Further, for example, with respect to the sub-heater 124*f*, because the sub-heater driving table is read from the fifth position from the right end, the driving signals are output in the order of 0, 0, 0, 0, 0, 1, 1, 1, 1, and 1.

If the reading start positions of the sub-heater driving table are set differently as described in the present exemplary embodiment, the output orders of the driving signals (i.e., driving/non-driving orders of the sub-heater) are offset with each other. Accordingly, a timing at which the sub-heater is switched from a non-driving state to a driving state, i.e., a timing at which inrush current occurs, can be set differently at each of the sub-heaters. With this configuration, a load of the electric circuit can be reduced, or a data transmission error can be reduced by suppressing occurrence of induction noise.

An actual driving timing of the sub-heater will be described below.

Figure 7:
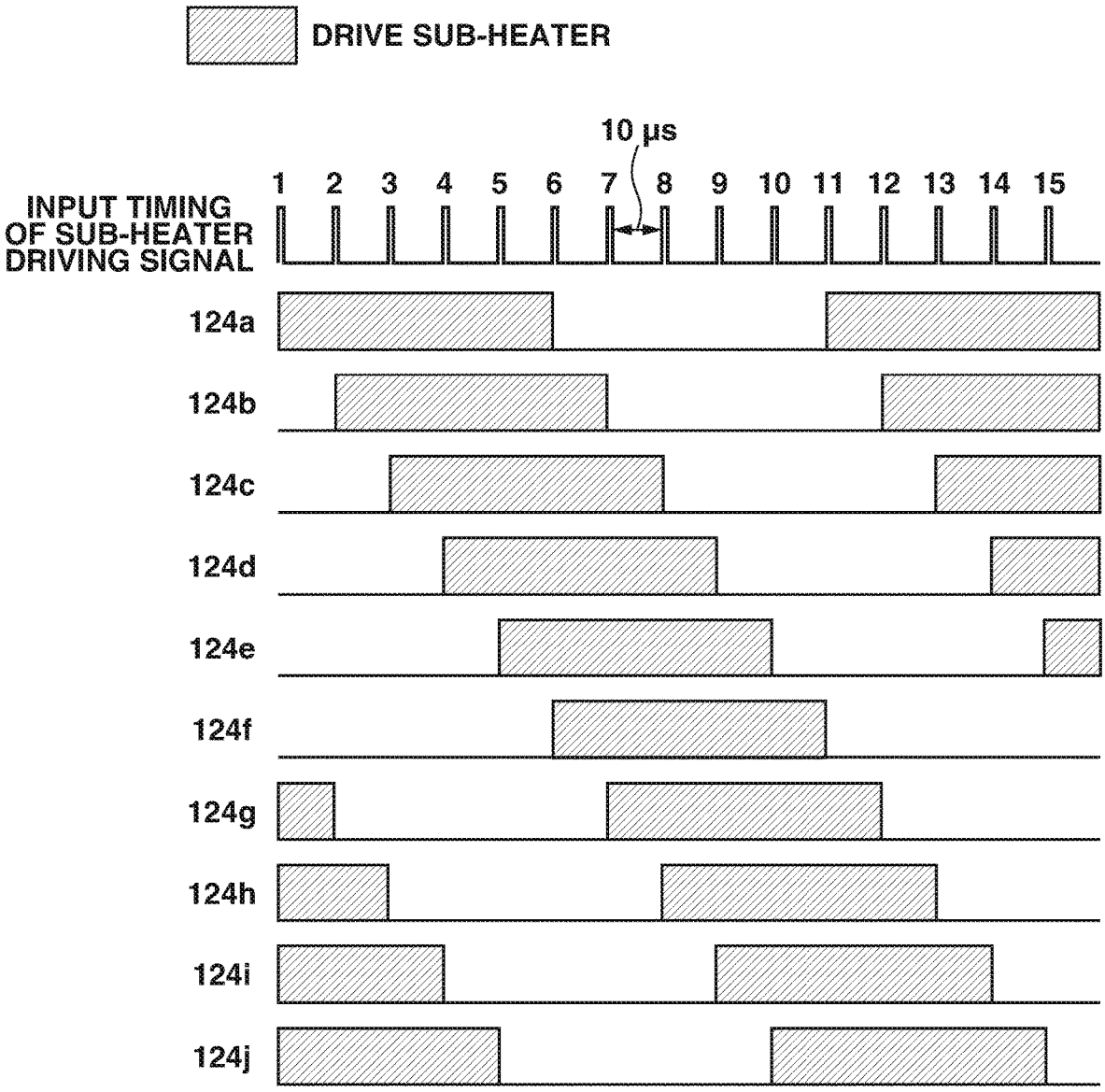
FIG. 7 is a diagram illustrating a sub-heater driving timing of the exemplary embodiment.

FIG. 7 is a diagram schematically illustrating actual driving timings of the sub-heaters 124*a* to 124*j* when the reading start position of the sub-heater driving table is set differently at each of the sub-heaters 124*a* to 124*j*. Herein, for the sake of simplicity, driving timings will be described with respect to the case where each of the temperature sensors 123*a* to 123*j* constantly detects the temperature lower than 50° C.

As described above, with respect to the sub-heater 124*a*, because reading is started from the left end, the driving signals are input in the order of 1, 1, 1, 1, 1, 0, 0, 0, 0, and 0. Accordingly, the sub-heater 124*a* is driven at the first to the fifth input timings of the driving signals. Then, the sub-heater 124*a* is not driven at the sixth to the tenth input timings of the driving signals. Then, the sub-heater 124*a* is driven again at the eleventh input timing of the driving signal. Accordingly, the sub-heater 124*a* is switched from a non-driving state to a driving state at the input timings of the first and the eleventh driving signals, which are the timings at which inrush current occurs.

With respect to the sub-heater 124*b*, because reading is started from the right end, the driving signals are input in the order of 0, 1, 1, 1, 1, 1, 0, 0, 0, and 0. Accordingly, the sub-heater 124*b* is not driven at the input timing of the first driving signal, and driven at the input timings of the second to the sixth driving signals. Then, the sub-heater 124*b* is switched to the non-driving state at the input timing of the seventh driving signal, and switched to the driving state at the input timing of the twelfth driving signal. As described above, with respect to the sub-heater 124*b*, there is a risk in which inrush current occurs at the input timings of the second and the twelfth driving signals.

Further, with respect to the sub-heater 124*f*, because reading is started from the fifth position from the right end, the driving signals are input in the order of 0, 0, 0, 0, 0, 1, 1, 1, 1, and 1. Accordingly, the sub-heater 124*f* is not driven at the input timings of the first to the fifth driving signals and switched to the driving state at the input timing of the sixth driving signal, and further switched to the non-driving state at the input timing of the eleventh driving signal. Accordingly, with respect to the sub-heater 124*f*, there is a risk in which inrush current occurs at the input timing of the sixth driving signal.

As illustrated in FIG. 7, according to the present exemplary embodiment, a timing at which inrush current occurs, i.e., a timing at which the sub-heater is switched from a non-driving state to a driving state, is set differently at each of the sub-heaters. Accordingly, as described above, an effect of reducing a load of the electric circuit or an effect of suppressing induction noise can be acquired.

In the above-described first exemplary embodiment, if a temperature detected by the temperature sensor is lower than the target temperature, sub-heater heating control is constantly executed at the same intensity.

On the other hand, in a second exemplary embodiment, sub-heater heating control is executed at different intensity according to a difference between a temperature detected by the temperature sensor and the target temperature.

Further, description of the configuration similar to that of the first exemplary embodiment will be omitted.

In the first exemplary embodiment, the sub-heater is driven if the temperature detected by the temperature sensor is lower than the target temperature, and the sub-heater is not driven if the detected temperature is higher the target temperature. However, in practice, even in a state where the detected temperature is lower than the target temperature, favorable driving intensity of the sub-heater, i.e., the favorable heating amount, is different depending on a difference between the detected temperature and the target temperature. For example, when the target temperature is 50° C., heating does not have to be executed so intensively if the detected temperature is 45° C. However, if the detected temperature is 20° C., it is preferable that the target temperature be achieved as quickly as possible by executing heating at a certain degree of intensity.

In consideration of the above situation, in the present exemplary embodiment, when the detected temperature is lower than the target temperature, sub-heater heating operation is executed at different sub-heater driving intensity based an the difference between the detected temperature and the target temperature. Therefore, the sub-heater driving table storage memory 313 of the present exemplary embodiment stores the sub-heater driving tables of two types, i.e., a first sub-heater driving table in which a correspondence between a temperature difference and a sub-heater driving intensity is specified, and a second sub-heater driving table in which a correspondence between the sub-heater driving intensity and the sub-heater driving pattern is specified. The sub-heater heating control using two types of sub-heater driving tables will be described below in detail.

Figure 8:
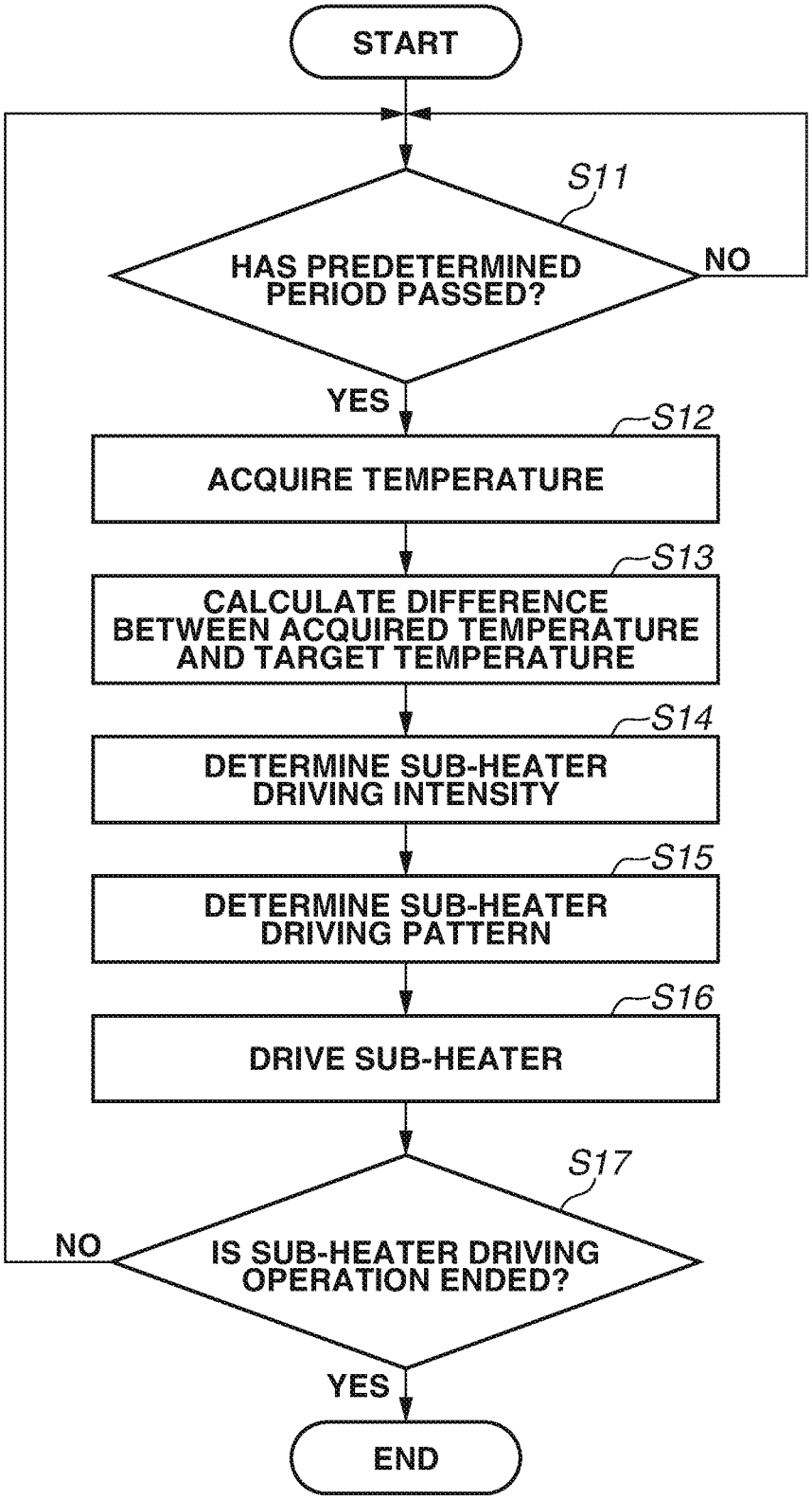
FIG. 8 is a flowchart illustrating heating control of the exemplary embodiment.

FIG. 8 is a flowchart of sub-heater heating control executed by the heating control unit 309 and the recording head 102*a* of the present exemplary embodiment. Herein, of the recording heads 102*a* to 102*h*, only control with respect to the recording head 102*a* will be described. However, similar control is also executed with respect to the other recording heads 102*b* to 102*h*.

The processing in steps S11 and S12 in FIG. 8 is similar to the processing in steps S1 and S2 illustrated in FIG. 5, so that description thereof will be omitted.

In step S13, a difference (temperature difference) between a predetermined target temperature and a temperature (detected temperature) detected at each of the temperature sensors 123*a* to 123*j* acquired in step S12 is calculated. This difference is calculated by subtracting the detected temperature from the target temperature. Accordingly, the detected temperature is higher than the target temperature if a negative value is acquired as a difference, and the detected temperature is lower than the target temperature if a positive value is acquired as a difference.

Next, in step S14, sub-heater driving intensity is determined based on the first sub-heater driving table stored in the sub-heater driving table storage memory 313 and the temperature difference at each temperature sensor calculated in step S13. As described above, the correspondence between the temperature difference and the sub-heater driving intensity is specified in the first sub-heater driving table. The sub-heater driving intensity corresponding to the temperature difference calculated in step S13 is determined with reference to the first sub-heater driving table.

FIG. 9 is a diagram illustrating the first sub-heater driving table used for the present exemplary embodiment. In the present exemplary embodiment, with respect to the case where the driving signal indicating driving of the sub-heater is input at all of the timings at which the sub-heater driving signal can be input, the intensity (heating amount) is set as 100%. Accordingly, for example, the intensity (heating amount) is 50% if the driving signal indicating driving of the sub-heater is received at half the number of timings at which the sub-heater driving signal can be input while the driving signal indicating non-driving of the sub-heater is received at another half the number thereof.

As illustrated in FIG. 9, in the first sub-heater driving table used in the present exemplary embodiment, a correspondence between the temperature difference and the sub-heater driving intensity is specified to make the sub-heater driving intensity be greater when the temperature difference is greater. Accordingly, by using, the first sub-heater driving table, heating can be executed more intensively if the temperature difference is greater, i.e., the detected temperature is much lower than the target temperature.

In step S15, the sub-heater driving pattern is determined based on the second sub-heater driving table stored in the sub-heater driving table storage memory 313 and the sub-heater driving intensity determined in step S14. As described above, a correspondence between the sub-heater driving intensity and the sub-heater driving pattern is specified in the second sub-heater driving table. The sub-heater driving pattern corresponding to the sub-heater driving intensity determined in step S14 is determined with reference to the second sub-heater driving table.

FIG. 10 is a diagram illustrating the second sub-heater driving table used for the present exemplary embodiment. In FIG. 10, "1" represents output of the sub-heater driving signal indicating driving, whereas represents output of the sub-heater driving signal indicating non-driving. Further, ten rows in the vertical direction indicate driving intensity of the sub-heater. Furthermore, at each of the rows in the vertical direction, the sub-heater driving signals are output according to passage of time while a reading position is being shifted from left to right, and the reading position returns to the left end after being shifted to the right end, so that the sub-heater driving signals are output while the reading position is being shifted from left to right again.

As illustrated in FIG. 10, in the second sub-heater driving table, the sub-heater driving pattern is determined to make the number of sub-heater driving signals indicating driving (represented by "1") be changed according to the sub-heater driving intensity. Specifically, the number of sub-heater driving signals indicating driving (represented by "1"), i.e., a number of driving times of the sub-heater, is greater if the sub-heater driving intensity is higher.

For example, when the sub-heater driving intensity is 90%, respective driving signals of 1, 1, 1, 1, 1, 1, 1, 1, 1, and 0 are specified from the left end of the second sub-heater driving table. Accordingly, nine driving signals indicate driving of the sub-heater.

Further, when the sub-heater driving intensity is 50%, respective driving signals of 1, 1, 1, 1, 1, 0, 0, 0, 0, and 0 are specified from the left end of the second sub-heater driving table. Accordingly, five driving signals indicate driving of the sub-heater.

Further, when the sub-heater driving intensity is 0%, respective driving signals of 0, 0, 0, 0, 0, 0, 0, 0, 0, and 0 are specified from the left end of the second sub-heater driving table. Accordingly, none of the driving signals indicates driving of the sub-heater.

As described above, by using the second sub-heater driving table, the number of driving, times of the sub-heater can be increased if the sub-heater driving intensity is higher.

Similar to the first exemplary embodiment, in the present exemplary embodiment, a reading start position of the sub-heater driving table is set differently with respect to the ten sub-heaters 124*a* to 124*j* arranged on the heater board 111. Details of the reading start positions for the sub-heaters 124*a* to 124*j* are illustrated in FIG. 10.

For example, with respect to the sub-heater 124*a*, reading is executed from the left end of the sub-heater driving table. Therefore, the driving signals are output in the order of 1, 1, 1, 1, 1, 1, 1, 1, 1, and 0 if the sub-heater driving intensity is 90%. Further, if the sub-heater driving intensity is 50%, the driving signals are output in the order of 1, 1, 1, 1, 1, 0, 0, 0, 0, and 0.

On the other hand, with respect to the sub-heater 124*b*, reading is executed from the right end of the sub-heater driving table. Therefore, the driving signals are output in the order of 0, 1, 1, 1, 1, 1, 1, 1, 1, and 1 if the sub-heater driving intensity is 90%. Further, if the sub-heater driving intensity is 50%, the driving signals are output in the order of 0, 1, 1, 1, 1, 1, 0, 0, 0, and 0.

As described above, in the present exemplary embodiment, when the output orders at the same sub-heater driving intensity are compared to each other, the output orders of the driving signals (i.e., driving/non-driving orders of sub-heaters) are also offset with each other. Accordingly, a timing at which the sub-heater is switched from a non-driving state to a driving state, i.e., a timing at which inrush current occurs, can be set differently at each of the sub-heaters. As described above, in the present exemplary embodiment, a load of the electric circuit can be reduced, or a data transmission error can be reduced by suppressing occurrence of induction noise.

An actual driving timing of the sub-heater will be described below.

First, a driving timing will be described with respect to the case where each of the temperature sensors 123*a* to 123*j* detects the temperature of 37° C. In this case, in step S13, the temperature difference is calculated as 13° C. at each of the temperature sensors 123*a* to 123*j*. In step S14, with reference to the first sub-heater driving table, the sub-heater driving intensity is determined as 50% because the temperature difference falls within a range of 10° C. or more and less than 15° C. at each of the temperature sensors 123*a* to 123*j*. Accordingly, in step S15, with reference to the second sub-heater driving table, the sub-heater driving pattern corresponding to the sub-heater driving intensity of 50% is read out. For example, with respect to the sub-heater 124*a*, because reading is started from the left end of the second sub-heater driving table, the driving signals are output in the order of 1, 1, 1, 1, 1, 0, 0, 0, 0, and 0. Further, with respect to the sub-heater 124*b*, because reading is started from the right end of the second sub-heater driving table, the driving signals are output in the order of 0, 1, 1, 1, 1, 1, 0, 0, 0, and 0. Similarly, with respect to the sub-heaters 124*c* to 124*j*, the driving signals are output in respective orders with reference to the second sub-heater driving table. Accordingly, actual driving timings of the respective sub-heaters are similar to those illustrated in FIG. 7 in the first exemplary embodiment. Accordingly, it can be understood that a timing at which inrush current occurs, i.e., a timing at which the sub-heater is switched from a non-driving state to a driving state, can be set differently at each of the sub-heaters when the temperature sensors 123*a* to 123*j* detect the temperature of 37° C.

Figure 11:
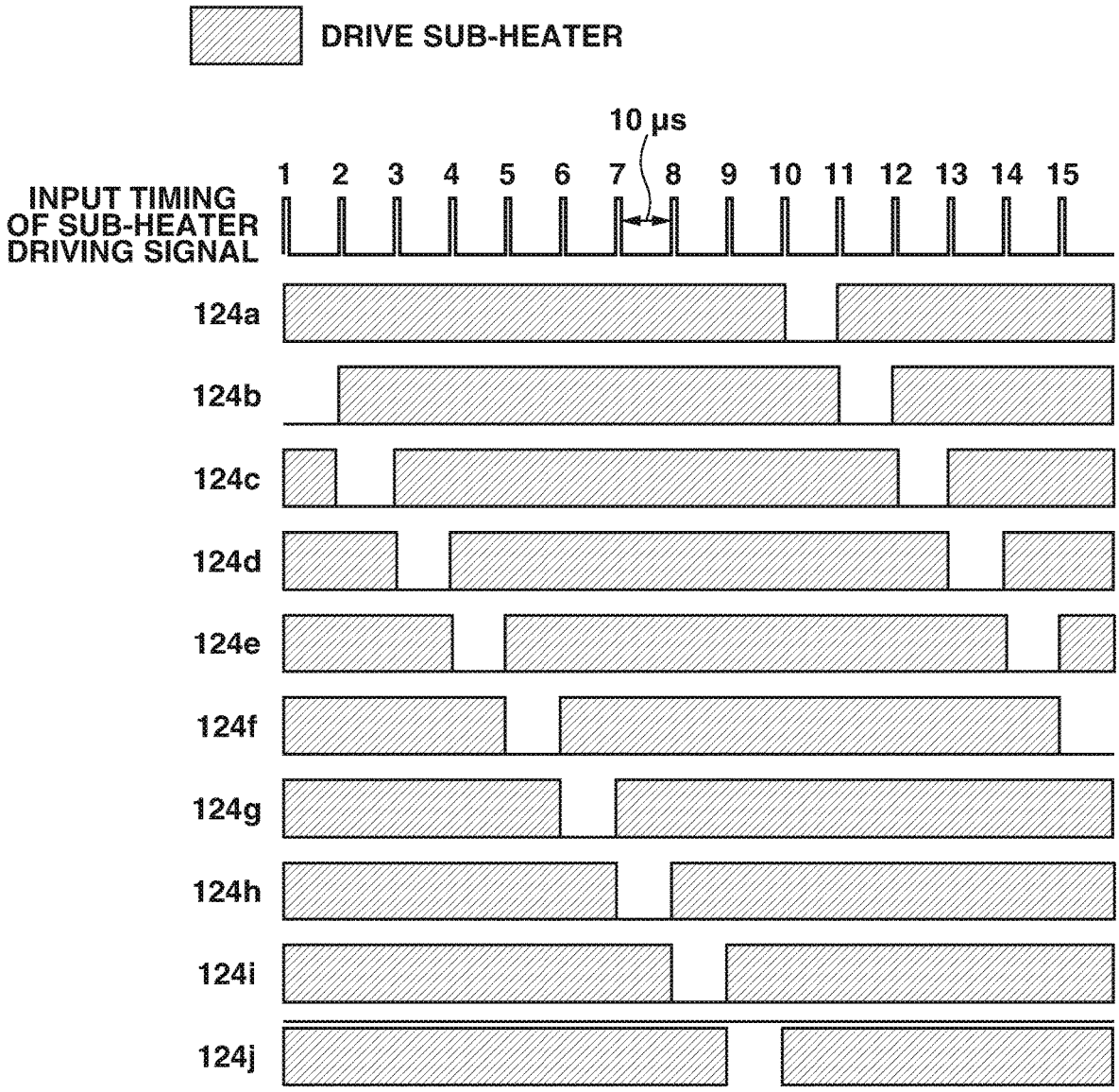
FIG. 11 is a diagram illustrating a sub-heater driving timing of the exemplary embodiment.

FIG. 11 is a diagram illustrating driving timings of respective sub-heaters when each of the temperature sensors 123*a* to 123*j* detects the temperature of 17° C. In this case, in step S13, the temperature difference is detected as 33° C. at each of the temperature sensors 123*a* to 123*j*. In step S14, with reference to the first sub-heater driving table, the sub-heater driving intensity is determined as 90% because the temperature difference falls within a range of 30° C. or more at each of the temperature sensors 123*a* to 123*j*. Accordingly, in step S15, with reference to the second sub-heater driving table, the sub-heater driving pattern corresponding to the sub-heater driving intensity of 90% is read out. For example, with respect to the sub-heater 124*a*, reading is started from the left end of the second sub-heater driving table. Therefore, the driving signals are output in the order of 1, 1, 1, 1, 1, 1, 1, 1, 1, and 0. Further, with respect to the sub-heater 124*b*, reading is started from the right end of the second sub-heater driving table. Therefore, the driving signals are output in the order of 0, 1, 1, 1, 1, 1, 1, 1, 1, and 1. Similarly, with respect to the sub-heaters 124*c* to 124*j*, the driving signals are output in respective orders with reference to the second sub-heater driving table. Accordingly, actual driving timings of respective sub-heaters are as illustrated in FIG. 11. Accordingly, it can be understood that a timing at which inrush current occurs, i.e., a timing at which the sub-heater is switched from a non-driving state to a driving state, can be also set differently at each of the sub-heaters when the temperature sensors 123*a* to 123*j* detect the temperature of 17° C.

As described above, according to the present exemplary embodiment, an effect of reducing a load of the electric circuit or an effect of suppressing induction noise can be acquired while heating is expedited by increasing the driving intensity when the temperature difference between the detected temperature and the target temperature is greater.

In the above-described exemplary embodiment, sub-heater driving tables of two types, the first sub-heater driving table in which a correspondence between the temperature difference and the sub-heater driving intensity is specified and the second sub-heater driving table in which a correspondence between the sub-heater driving intensity and the sub-heater driving pattern is specified are used. In other words, a correspondence between the temperature difference and the sub-heater driving pattern is not specified directly but specified indirectly by the first and the second sub-heater driving tables. However, the present invention is not limited to the above. For example, an effect similar to the effect of the present exemplary embodiment can be acquired by using only one type of sub-heater driving pattern in which a correspondence between the temperature difference and the sub-heater driving pattern is directly specified as illustrated in FIG. 12.

In the first and the second exemplary embodiments, a reading start position of the sub-heater driving table (i.e., second sub-heater driving table) is set differently at each of the sub-heaters arranged an one heater board.

On the contrary, in a third exemplary embodiment, the same reading start position of the sub-heater driving table is specified with respect to a part of the sub-heaters.

Description of a configuration similar to that the first or the second exemplary embodiment will be omitted.

In the present exemplary embodiment, sub-heater heating control is executed according to the flowchart illustrated in FIG. 5. Herein, the sub-heater driving table used in step S3 is different from that of the first exemplary embodiment.

FIG. 13 is a diagram illustrating a sub-heater driving table used for the present exemplary embodiment. In the sub-heater driving table, "1" represents output of a driving signal indicating driving of the sub-heater, whereas "0" represents output of a driving signal indicating non-driving of the sub-heater.

Of the rows one above the other in FIG. 13, the upper row illustrates a sub-heater driving pattern of the driving signals to be output when the temperature is less than 50° C., and the lower row illustrates a sub-heater driving pattern of the driving signals to be output when the temperature is 50° C. or more. Further, the driving signals are output according to passage of time while the reading position is being shifted from left to right every 10 μs, and the reading position returns to the left end after being shifted to the right end, so that the driving signals are output while the reading position is being shifted from left to right sequentially.

As illustrated in FIG. 13, in the present exemplary embodiment, the same reading start position of the sub-heater driving pattern is specified with respect to a pair of sub-heaters 124*a* and 124*f*, so that the sub-heater driving table is read from the left end at both of the sub-heaters 124*a* and 124*f*. Further, the same reading start position of the sub-heater driving pattern is specified with respect to a pair of sub-heaters 124*b* and 124*g*, so that the sub-heater driving table is read from the right end at both of the sub-heaters 124*b* and 124*g*. Similarly, the same reading start position of the sub-heater driving pattern is specified with respect to a pair of sub-heaters 124*c* and 124*h*, a pair of sub-heaters 124*d* and 124*i*, or a pair of sub-heaters 124*e* and 124*j*.

Specifically, if the temperature is lower 50° C., the driving signals are output in the order of 1, 1, 1, 1, and 0 with respect to the sub-heaters 124*a* and 124*f*. Further, the driving signals are output in the order of 0, 1, 1, 1, and 1 with respect to the sub-heaters 124*b* and 124*g*.

An actual driving timing of the sub-heater will be described below.

Figure 14:
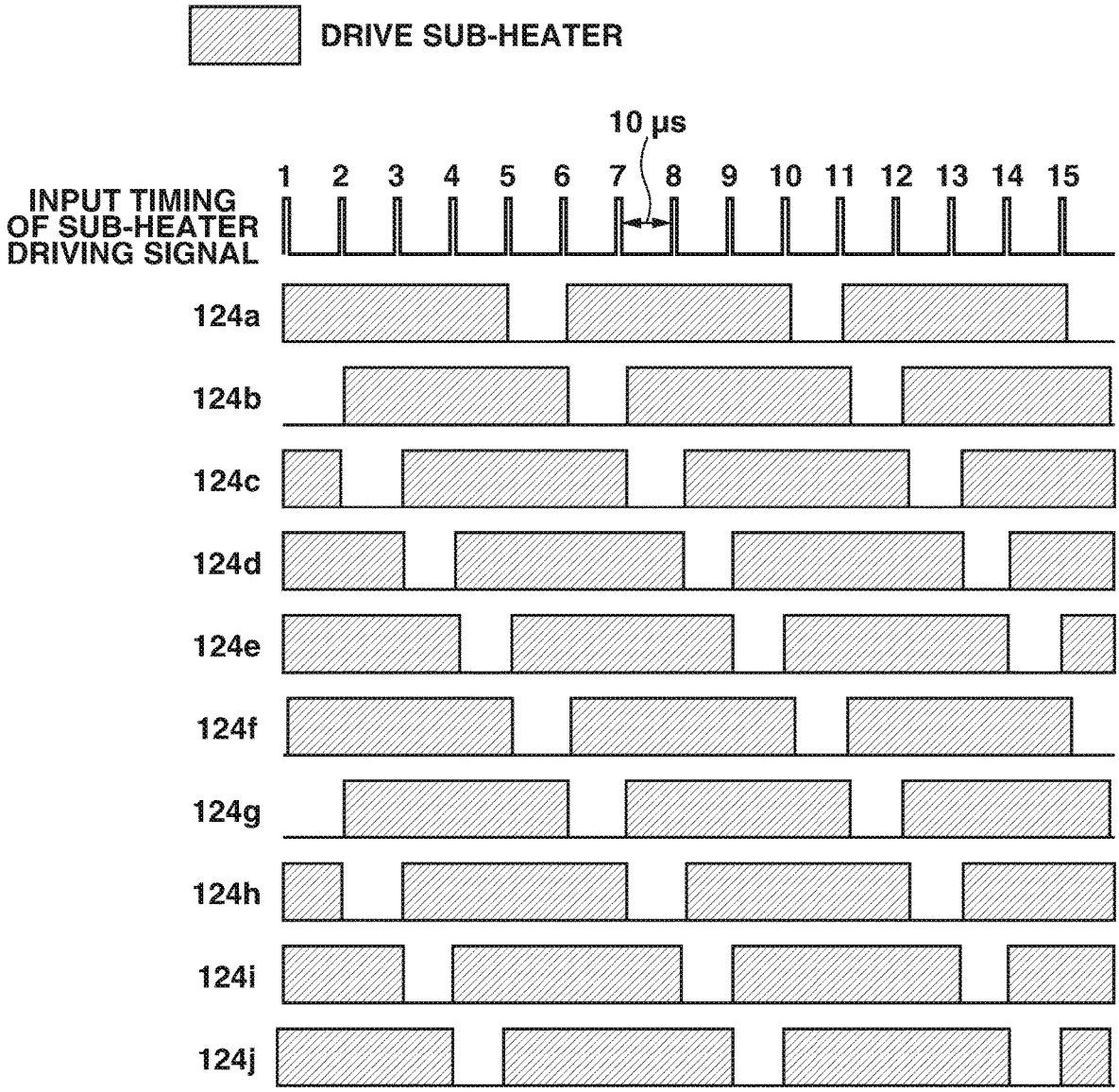
FIG. 14 is a diagram illustrating a sub-heater driving timing of the exemplary embodiment.

FIG. 14 is a diagram illustrating driving timings of respective sub-heaters when the temperature sensors 123*a* to 123*j* detect the temperature less than 50° C.

As illustrated in FIG. 14, in the present exemplary embodiment, driving or non-driving of sub-heaters belonging to the same pair (e.g., sub-heaters 124*a* and 124*f*) is executed at the same timing. Therefore, if attention is given to only the sub-heaters belonging to the same pair, timings at which inrush current occurs, i.e., timings at which the sub-heaters are switched from a non-driving state to a driving state, are superimposed with each other.

However, with respect to the sub-heaters belonging to different pairs, different reading start positions of the sub-heater driving pattern are specified thereto. Thus, it is possible to make the timings at which the sub-heaters are switched from a non-driving state to a driving state be different from each other. Therefore, in comparison to the case where all of the sub-heaters are switched from a non-driving state to a driving state at the same timing, it is possible to further acquire the effect of reducing the load of the electric circuit or the effect of suppressing induction noise.

In addition, in the above-described exemplary embodiments, although temperature information detected by the temperature sensor is updated every 1500 μs, this period may be changed as appropriate. Further, in the above-described exemplary embodiments, although only a temperature detected at a certain timing is used for the heating control, a temperature detected prior to that timing may be also used. For example, if one temperature is detected from a temperature sensor at one timing, a moving average between the one temperature and a temperature detected at a timing just before the one timing (e.g., 1500 μs before) may be calculated to be used for the heating control. If the above-described average temperature is used, there is a risk that the temperature may be deviated from the precise temperature detected at each timing. However, in a case where deviations occur in measurement of the detected temperature due to an influence of noise, deviations caused by the influence of noise can be reduced to some extent.

Further, in the above-described exemplary embodiments, the same sub-heater driving table is used for the respective sub-heaters, and superimposition of inrush current is suppressed by changing the reading start position of the sub-heater driving table. However, the present invention is not limited thereto. For example, different sub-heater driving tables may be used for the respective sub-heaters. In this case, the effect similar to the effect acquired from the other exemplary embodiments can be acquired if the respective sub-heater driving tables are specified to make the timings at which the sub-heaters are switched from a non-driving state to a driving state be different from each other.

Further, in the above-described exemplary embodiments, although a reading start position of the sub-heater driving pattern is always set differently at each of the sub-heaters, the present invention is not limited thereto. For example, it may be determined whether timings at which inrush current is increased (i.e., timings at which the sub-heaters are switched from a non-driving state to a driving state) are superimposed with each other, and the reading start position may be switched to the reading start position described in the above-described exemplary embodiment only when it is determined that the timings are superimposed with each other.

Further, in the above-described exemplary embodiments, signals indicating driving of the sub-heater and signals indicating non-driving thereof are output respectively in a consecutive manner. For example, in the upper row in FIG. 6, five driving signals indicating driving are output consecutively from the left end. Then, five driving signals indicating non-driving are consecutively output up to the right end. Although the driving signals indicating driving and the driving signals indicating non-driving do not always have to be output consecutively as described in the respective exemplary embodiments, the driving signals can be output consecutively to some extent. For example, if a driving signal indicating driving and a driving signal indicating non-driving are alternately output, even if a reading start position is set differently at each of the sub-heaters, timings at which a non-driving state is switched to a driving state are superimposed to a certain extent (approximately half the number of sub-heaters). In order to avoid the above situation, the driving signals indicating driving and the driving signals indicating non-driving can be output respectively in a consecutive manner.

Further, in the above-described exemplary embodiments, after ink is applied to the transfer body (first recording medium) from the recording head, recording is performed on a recording sheet (second recording medium) by transferring an image formed on the transfer body to the recording sheet. However, the present invention is not limited thereto. For example, ink may be directly applied to a recording sheet from the recording head.

Further, in the above-described exemplary embodiments, although a recording head having a length longer than a width of a recording medium is used, the present invention is not limited thereto. For example, recording operation of making the recording head discharge ink while scanning in a direction intersecting with an array direction of discharge ports and conveyance operation of conveying a recording medium in the array direction between the scans may be executed repeatedly, so that recording with respect to the recording medium may be completed by a plurality of times of scanning (moving) operation.

According to the recording apparatus of the present invention, a negative effect caused by superimposition of inrush current can be suppressed in a case where a recording head having a plurality of heating elements arranged on a same substrate is to be used.

While the present invention has been described with reference to exemplary embodiments, it is to be understood that the invention is not limited to the disclosed exemplary embodiments.

This application claims the benefit of Japanese Patent Application No. 2017-074679, filed Apr. 4, 2017, which is hereby incorporated by reference herein in its entirety.

What is claimed is:

1. A recording apparatus comprising:

a recording head including a substrate provided with a plurality of recording elements configured to generate energy for discharging ink, a first heating element configured to heat ink in the vicinity of one of said recording elements positioned at a first position, insufficiently to discharge ink, and a second heating element configured to heat ink in the vicinity of a recording element positioned at a second position different from the first position, insufficiently to discharge ink;

a heating control unit configured to control the heating operation of the ink by driving the first and the second heating elements by applying voltage to the first and the second heating elements;

a recording control unit configured to control the recording operation by driving the plurality of recording elements; and a memory configured to store driving information that represents a pattern of a signal of driving or non-driving for a heating element, wherein, in a case where the first heating element and the second heating element are driven within a predetermined period, the heating control unit controls the heating operation to drive the first heating element based on first information obtained by reading the stored driving information in order from a first start position and to drive the second heating element from a driving starting timing being different from a driving start timing from which the first heating element is driven based on second information obtained by reading the stored driving information in order from a second start position which is different from the first start position.

2. The recording apparatus according to claim 1, wherein the heating control unit controls the heating operation by executing driving and non-driving of the first heating element in a first sequence while executing driving and non-driving of the second heating element in a second sequence different from the first sequence.

3. The recording apparatus according to claim 2, wherein the first sequence and the second sequence are sequences offset with respect to each other.

4. The recording apparatus according to claim 3, wherein each of the first sequence and the second sequence is a sequence in which respective signals for driving and non-driving are input consecutively.

5. The recording apparatus according to claim 3, wherein the first sequence and the second sequence are sequences in which the first heating element and the second heating element are switched from non-driving to driving at timings different from each other.

6. The recording apparatus according to claim 1, further comprising:

a first detection element arranged to detect a temperature in a vicinity of the recording element positioned at the first position;

a second detection element arranged to detect a temperature in a vicinity of the recording element positioned at the second position, the first and second detection elements being further arranged on the substrate; and an acquisition unit configured to acquire temperature information about temperatures respectively detected by the first detection element and the second detection element, wherein the heating control unit controls heating operation based on the temperature information acquired by the acquisition unit.

7. The recording apparatus according to claim 6, wherein a table specifies a correspondence between temperature information and driving information that indicates driving or non-driving of the first and the second heating elements at respective timings, wherein the heating control unit controls the heating operation based on the temperature information acquired by the acquisition unit and the table.

8. The recording apparatus according to claim 7, wherein, in the table, the correspondence is specified to make a number of signals indicating information about driving of the first and the second heating elements be changed according to a value indicated by the temperature information acquired by the acquisition unit.

9. The recording apparatus according to claim 8, wherein the acquisition unit is configured to acquire the temperature information based on a difference between a value indicated by temperature information corresponding to each of the first and the second detection elements and a target temperature for heating ink controlled by the heating control unit.

10. The recording apparatus according to claim 9, wherein the acquisition unit is configured to acquire an average temperature of temperatures respectively detected by the first and the second detection elements at a timing at which the heating control unit executes control of the heating operation and temperatures respectively detected by the first and the second detection elements at a timing prior to said timing, and acquires information indicating the average temperature as the temperature information.

11. The recording apparatus according to claim 7, wherein the heating control unit is configured to change a reading start position in the pattern according to whether driving of the first heating element is executed or driving of the second heating element is executed.

12. The recording apparatus according to claim 6, further comprising:

a memory configured to store a first table in which a correspondence between temperature information and driving information about driving or non-driving of the first heating element at each timing is specified and a second table in which a correspondence between temperature information and driving information about driving or non-driving of the second heating element at each timing is specified, wherein the heating control unit controls the heating operation of the first heating element based on the temperature information corresponding to the first detection element acquired by the acquisition unit and the first table, and to control the heating operation of the second heating element based on the temperature information corresponding to the second detection element acquired by the acquisition unit and the second table.

13. The recording apparatus according to claim 12, wherein, in each of the first table and the second table, the correspondence is specified to make the driving information be read out in a sequence different from each other in a case where both of temperature information corresponding to the first detection element and temperature information corresponding to the second detection element indicate a same temperature.

14. The recording apparatus according to claim 1, wherein the recording head includes the substrate on which a recording element array including the plurality of recording elements arrayed in a predetermined direction is arranged, and wherein the first heating element and the second heating element are arranged on the substrate at positions different from each other in the predetermined direction.

15. The recording apparatus according to claim 1, wherein the recording head includes a plurality of recording element arrays including the plurality of recording elements arrayed in a predetermined direction, and the plurality of recording element arrays is arranged on the substrate in an intersecting direction intersecting with the predetermined direction, wherein the first heating element and the second heating element are arranged at positions different from each other in the intersecting direction on the substrate.

16. A recording method of executing recording by using a recording head including a substrate provided with a plurality of recording elements for generating energy for discharging ink, a first heating element for heating ink in a vicinity of a recording element positioned at a first position to a certain extent the ink is not discharged, and a second heating element for heating ink in a vicinity of a recording element positioned at a second position different from the first position to a certain extent the ink is not discharged, the method comprising:

controlling, by heating control, heating operation of ink by driving the first and the second heating elements by applying voltage to the first and the second heating elements; and controlling, by recording control, recording operation by driving the plurality of recording elements, wherein, in a case where the first heating element and the second heating element are driven within a predetermined period in the heating control, the heating operation is executed such that the first heating element is driven based on first information obtained by reading the stored driving information in order from a first start position and the second heating element is driven from a driving starting timing being different from a driving start timing from which the first heating element is driven based on second information obtained by reading the stored driving information in order from a second start position which is different from the first position.

* * * * *